US005779314A

United States Patent [19]

Grace

[11] Patent Number: 5,779,314

[45] Date of Patent: Jul. 14, 1998

[54] COLLAPSIBLE MULTI-PURPOSE CHAIR

[76] Inventor: Daniel Grace, 11 Goodrich Ave., Cromwell, Conn. 06416

[21] Appl. No.: 502,714

[22] Filed: Jul. 14, 1995

[51] Int. Cl.[6] ..... B60N 2/02

[52] U.S. Cl. ..... 297/380; 297/377; 297/25; 297/40

[58] Field of Search ..... 297/380, 378.1, 297/25, 31, 53, 40, 377

[56] References Cited

U.S. PATENT DOCUMENTS

| | | | |
|---|---|---|---|
| 812,013 | 2/1906 | Brower et al. . | |
| 3,005,659 | 10/1961 | Sanders | 297/19 |
| 3,929,373 | 12/1975 | Gawlinski | 297/19 |
| 4,186,959 | 2/1980 | Thebaud | 297/16 |
| 4,772,068 | 9/1988 | Gleckler | 297/39 |
| 5,498,054 | 3/1996 | Tomlinson | 297/53 X |

*Primary Examiner*—Peter M. Cuomo
*Assistant Examiner*—Stephen Vu
*Attorney, Agent, or Firm*—McCormick, Paulding & Huber

[57] ABSTRACT

A folding chair for use on both level and inclined supporting surfaces has a back support and a front leg assembly pivotally connected to a bottom for independent forward and rearward movement relative to the bottom and to each other between operative and collapsed positions. A flexible retaining strap of adjustable length maintains the front legs in selected angular position relative to the bottom and holds the bottom in a generally horizontally disposed position when the chair is supported on an inclined surface. A flexible carrying strap of adjustable length maintains the back in a comfortable back supporting position relative to the bottom. Lifting the chair by the carrying strap automatically collapses the chair into a compact bundle which may be carried on a shoulder by the carrying strap. Collapsible rear legs may be provided for supporting the chair bottom at a conventional chair seat height above a supporting surface.

41 Claims, 6 Drawing Sheets

COLLAPSIBLE MULTI-PURPOSE CHAIR

BACKGROUND OF THE INVENTION

This invention relates in general to chairs and seats and deals more particularly with an improved portable foldable or collapsible chair particularly adapted for use on both level and inclined supporting surfaces.

Many outdoor entertainment and sporting events, such as band concerts, parades, air shows, pyrotechnic displays, golf tournaments and the like lack seating accommodations, requiring that each spectator provide his or her own chair or otherwise stand or sit upon the ground. Folding chairs are presently available in a wide range of designs but generally lack the desired degree of portability for such usage. Lightweight portable seats which do not provide back support are uncomfortable when used for a prolonged period. Further, such portable seats and folding chairs are usually wholly unsuitable for use on a hill or other inclined surface which often offers the best vantage point for viewing an event.

Accordingly, it is the general aim of the present invention to provide an improved, lightweight, collapsible multi-purpose chair for use on both level ground or on hills or inclines and which provides back support, includes a carrying strap, and is automatically collapsible into and retained in a compact bundle when picked up and carried by the carrying strap in a carrying position. A further aim of the invention is to provide a sturdy, secure low profile folding chair for low cost manufacture and for low-to-the-ground seating to provide comfort for a user viewing an event without obstructing the view of other spectators and which may also serve as a conventional chair having a conventional seat height.

SUMMARY OF THE INVENTION

In accordance with the present invention a collapsible incline or hill chair has a bottom, front legs and a back supported for movement between unfolded or operative and folded or collapsed positions. Front leg retaining means maintain the front legs in operative position relative to the bottom when the chair is in its unfolded or operative position. The chair further includes carrying means for maintaining the back in an operative or back supporting position relative to the bottom and for moving the front legs and the back to collapsed position relative to the bottom when the carrying means is brought to carrying position. The carrying means maintains the front legs and the back in collapsed condition when the chair is carried by the carrying means in a carrying position.

DETAILED DESCRIPTION OF PREFERRED EMBODIMENT

Figure 1:
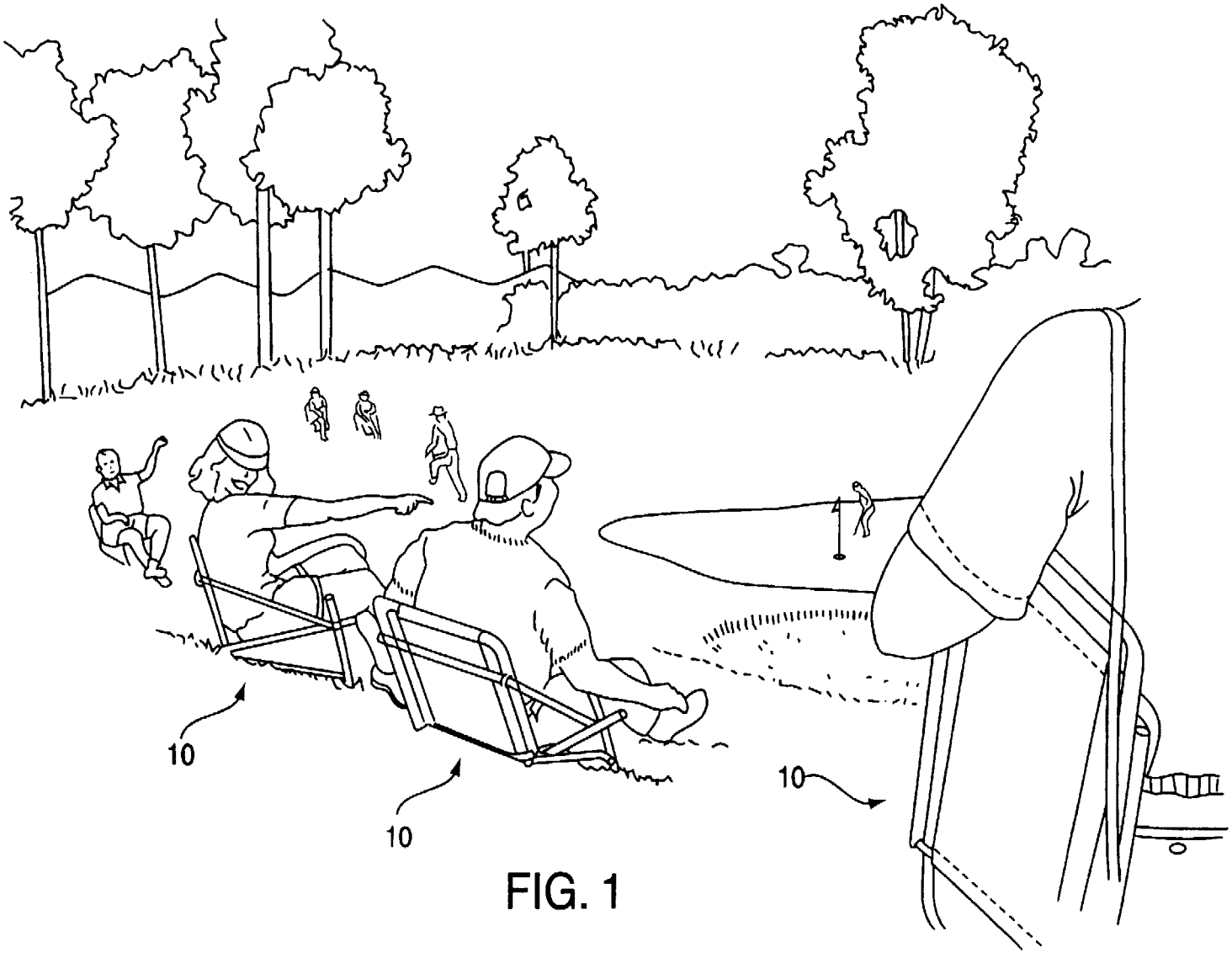
FIG. 1 is a perspective view of a golf tournament scene showing incline chairs embodying the invention in use on a hill or incline.

Turning now to the drawings, FIG. 1 illustrates collapsible or foldable chairs embodying the present invention, indicated generally by the reference numeral 10 and in use on an inclined surface at a golf tournament. The chair 10 in the right foreground is shown in a carrying position.

Referring now particularly to FIGS. 2–5, a typical collapsible chair 10 embodying the present invention has a foldable frame indicated generally at 12 which supports flexible seat and back panels made from fabric or other suitable material. The illustrated chair 10 essentially comprises a bottom or seat indicated generally at 14, a pair of front legs 16, 16 supported by the bottom for movement between operative and collapsed positions, and a back designated generally by the numeral 18 and supported by the bottom for movement between operative and collapsed positions. A flexible front leg retaining strap indicated generally at 20 maintains the front legs in operative position relative to the bottom 14 and a flexible carrying strap designated generally by the numeral 22 retains the back in an operative or back supporting position relative to the seat when the chair is in its unfolded or open position. The carrying strap also comprises a means for collapsing the chair from its unfolded to its folded or carrying position and for maintaining and carrying the chair in the latter position, all of which is hereinafter more fully described.

Figure 2:
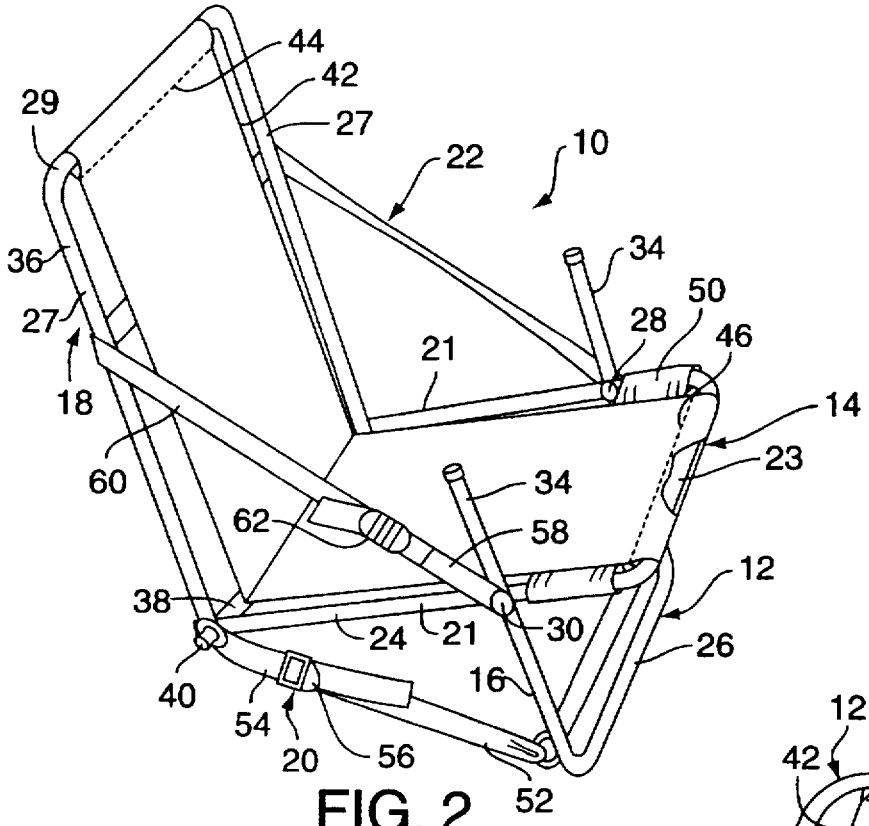
FIG. 2 is a perspective view of a collapsible chair shown in operative condition.
Figure 5:
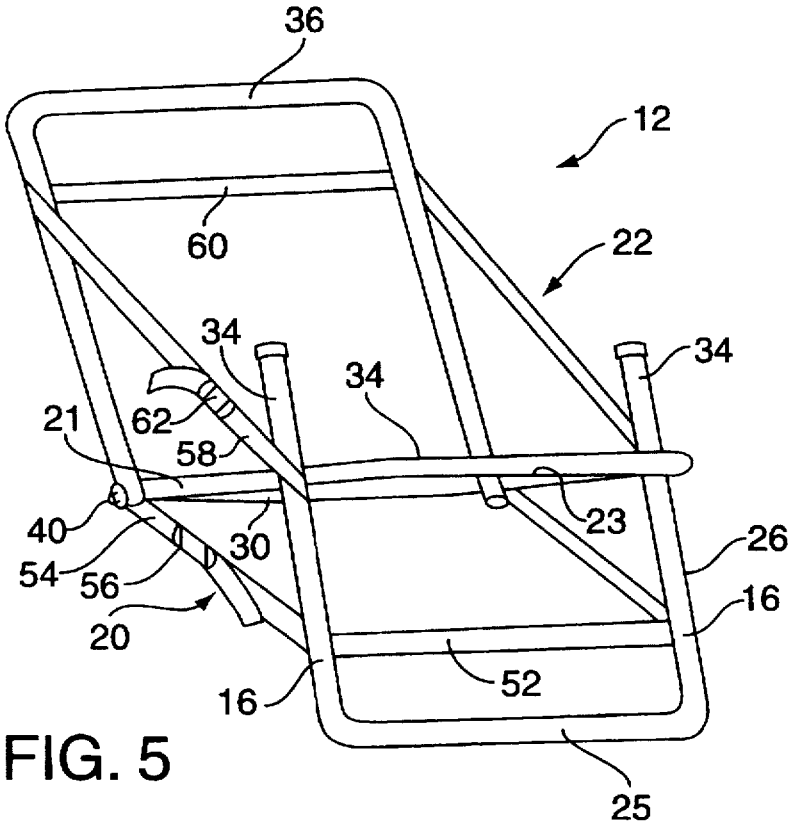
FIG. 5 is a perspective view of the chair frame.

Various materials and construction methods may be employed in making the foldable incline chair of the present invention. However, in accordance with the presently preferred construction, the frame 12, shown in FIG. 5, is formed from durable lightweight tubular metal. The bottom or seat portion of the frame comprises a generally U-shaped tubular bottom frame indicated generally at member 24 which includes a pair of parallel side portions 21, 21 and a front portion 23 integrally connected to the forward ends of said side portions and extending laterally therebetween, as best shown in FIG. 2. A generally U-shaped tubular front frame member 26 defines two front legs 16, 16 and a connecting portion 25 connected to and extending between the lower ends of the legs 16, 16. The front frame member 16 straddles the bottom 14 and is pivotally connected to the bottom member 24 in rearwardly spaced relation to the front end portion of the bottom member, substantially as shown. Each side portion 21 is attached intermediate its end to an associated leg 16 by a short pivot pin 28 which is headed at its inner end. The lower or outer end of each pivot pin 28 is secured by a fastener 30. Fasteners of a lock-on type adapted to be pushed onto and securely grip and lock on the free end of a pin or rod are presently preferred for this purpose.

Figure 4:
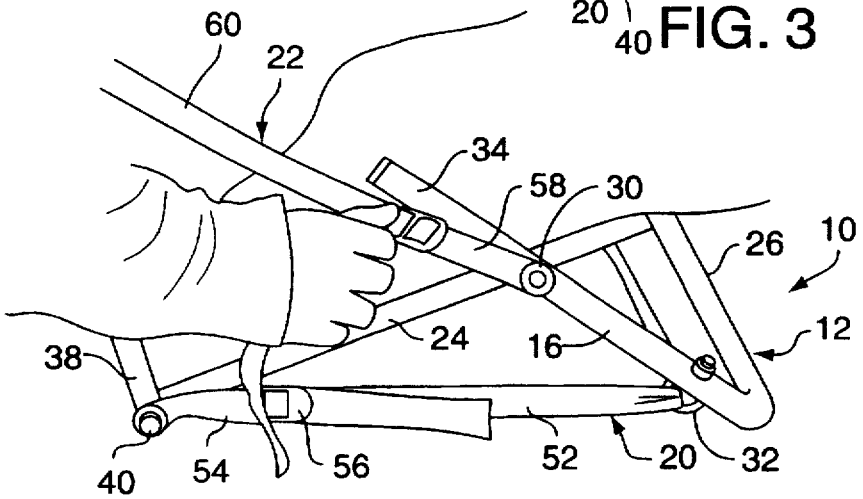
FIG. 4 is a somewhat enlarged fragmentary perspective view illustrating the arrangement for adjusting the angular position of the chair back relative to the chair seat or bottom.

Each leg 16 has an eye 32 projecting from its rear surface near its lower end, as best shown in FIG. 4. The eyes 32, 32 may be welded or otherwise secured to the legs by any suitable means, such as by a fastener. The leg 16, 16 include upper end portions 34, 34 which extend upwardly above the pivot pins 28, 28 when the chair 10 is in its unfolded or open position, for a purpose which will be hereinafter evident.

Figure 3:
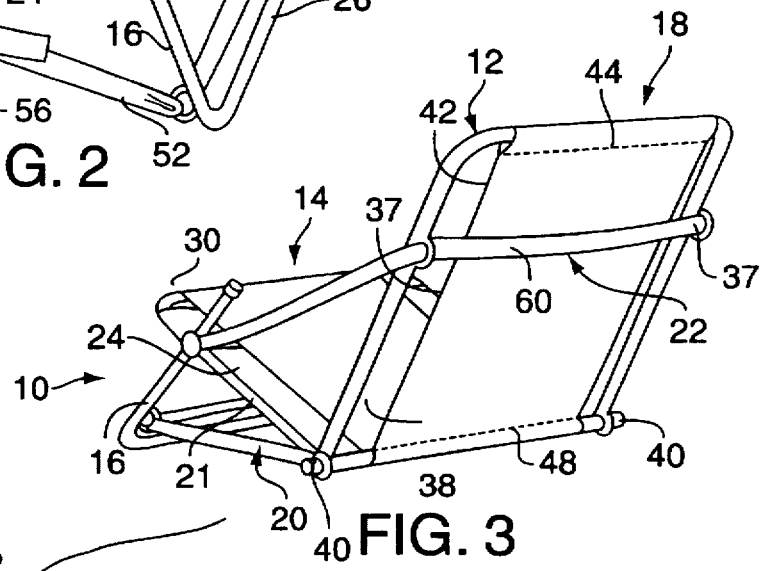
FIG. 3 is another perspective view of the chair shown in FIG. 1.

The back 18 comprises a generally U-shaped tubular back frame member 36 similar to the bottom member 24 and the front member 26 and includes a pair of back side members 27, 27 integrally connected at the upper ends thereof by an upper connecting member 29 which extends laterally between the upper ends. The free end portions of the U-shaped back frame member 36 straddle the free rear end portions of the U-shaped bottom frame member 24 and are pivotally connected thereto by a pivot rod 38 which extends transversely across the frame 12 bottom frame member 24 and the lower ends of the back frame member 36 back frame member 36. The pivot rod 38 is secured to the frame 12 by push-on lock fasteners 40, 40, similar to those used to secure the pivot pins 28, 28. A pair of eyes 37, 37 are connected at the rear of the side members of the U-shaped back frame, substantially as shown in FIG. 3. Preferably, and as shown, the eyes 37, 37 are located above the center of the back frame side members when the chair is in its unfolded condition, as shown in FIG. 3.

The material which forms the chair back and seating panels may take various forms and may be attached to the frame 12 in a variety of differing ways. However, in accordance with the illustrated construction the chair back and seating surfaces are formed by a single sheet of flexible fabric 42, as, for example, canvas hemmed at 44, 46 and 48 to respectively receive the front portion of the bottom member 24, the upper portion of the back frame member 36 and the pivot rod 38, as best shown in FIGS. 2 and 3. A fabric reinforcing panel 50 connected to opposite side portions of the bottom frame member 24 forward of the pivot pins 28, 28, extend transversely between the latter side members and below the seat panel to provide reinforcement for the seat panel.

When the chair 10 is unfolded and in its open or operative position the front member 26, which defines the front legs 16, 16, is maintained in operative position relative to the bottom 14 by the elongated flexible member or retaining strap 20. The retaining strap 20 preferably comprises an assembly formed by two parts 52 and 54 joined by a suitable adjustable fastener such as the illustrated buckle 56, which facilitates rapid adjustment of the strap length. The strap 52, the longer of the two straps, is threaded through the eyes 32, 32 and has its opposite ends secured at opposite sides of the frame 12 by the pivot rod 38. The buckle 56 is preferably located at one side of the chair, substantially as shown in FIG. 2.

When the chair is in its open or operative position, as it appears in FIGS. 2 and 3, the back of the chair is held in back supporting position by the carrying strap 22. Like the retaining strap assembly 20, the carrying strap 22 preferably comprises an assembly of two parts, 58 and 60, joined by a suitable adjustable fastener or buckle 62. The longer strap 60 is threaded through the eyes 37, 37. The end portions of the carrying strap assembly 22 are respectively connected to opposite sides of the chair frame 12 by the pivot pins 28, 28, substantially as shown. The buckle 62 is preferably located in a readily accessible position at the side of the chair 10, as best shown in FIGS. 2 and 5.

A person seated in the chair 10 on either an inclined or a level surface may adjust the chair from seated position by releasing the buckle 56 and pulling in on or letting out the free end of the strap 52 to change the angle of the front legs 16, 16 relative to the bottom 14. In like manner, the angular position of the back 18 may be adjusted relative to the seat 14 by drawing up on or letting out the free end of the strap 60, as shown in FIG. 4. Since the chair seat is located close to the ground, the upwardly extending portions 34, 34, provide convenient hand support for a person seating himself upon or getting up from the chair.

Figure 6:
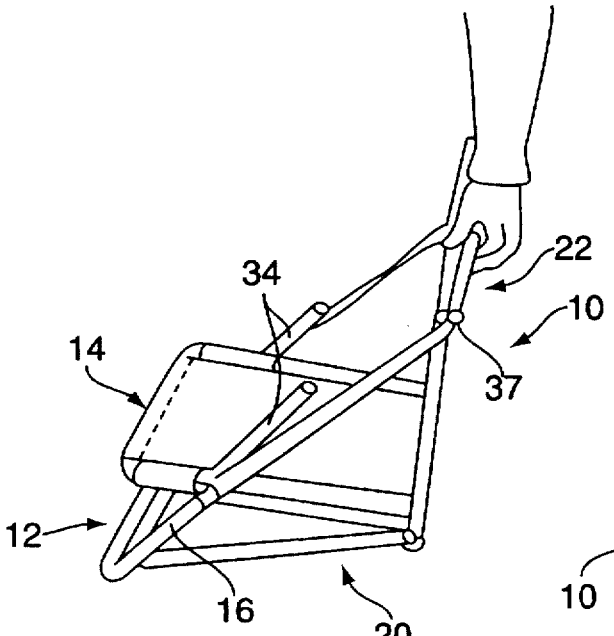
FIG. 6 is a somewhat reduced perspective view illustrating the initial step in folding the chair to its collapsed or carrying position.
Figure 7:
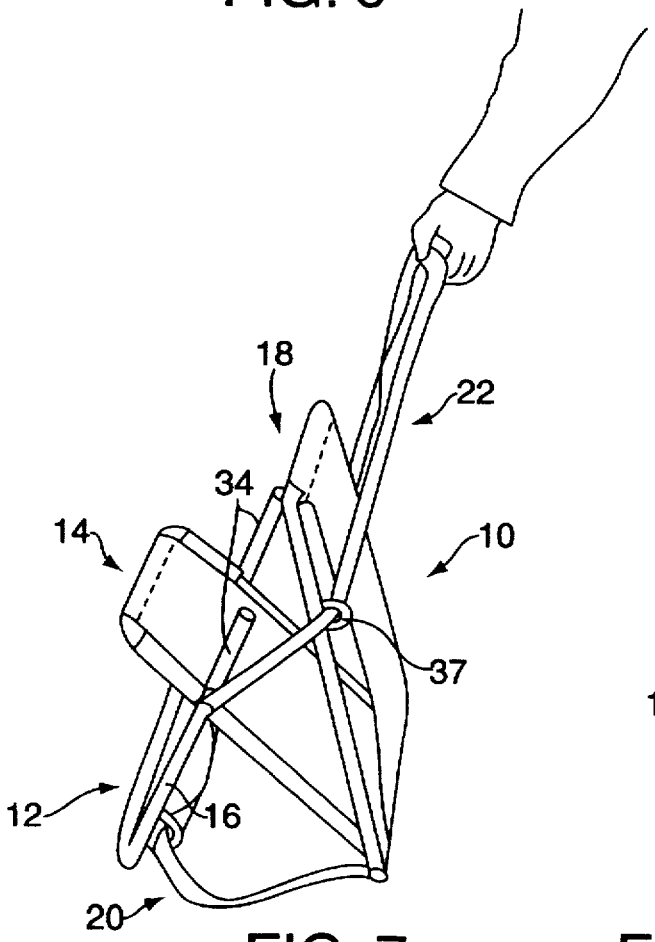
FIG. 7 illustrates the chair in a partially collapsed position.

When the chair 10 is resting on the ground in its unfolded or operative position, it may be automatically collapsed to its folded or carrying position by grasping a central portion of the carrying strap 22 at the rear of the chair back 18, as shown in FIG. 6. When the chair is lifted by the carrying strap 22, the weight of the chair borne by the carrying strap causes the eyes 32, 32 to slide downwardly along the carrying strap thereby pivoting the bottom 14 in clockwise direction and toward the chair back as it appears in FIG. 7. The front legs 16, 16 pivot in a counterclockwise direction from the position shown in FIG. 7 and toward the bottom 14 as the chair is lifted by its carrying strap 22.

Figure 8:
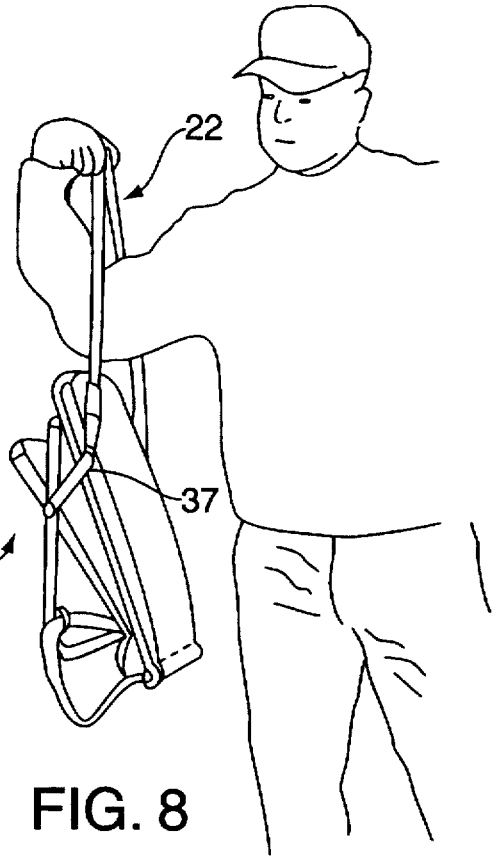
FIG. 8 shows the chair being brought to a shoulder carrying position.
Figure 9:
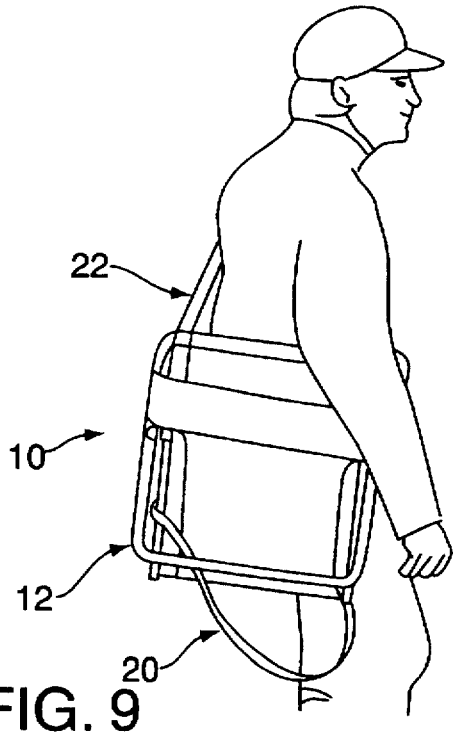
FIG. 9 illustrates the chair in its carrying position.

As the chair 10 is brought to a shoulder carrying position, as shown in FIG. 8, it automatically collapses into a compact bundle which may be easily supported on the shoulder by the carrying strap 20. The weight of the chair acting upon the carrying strap maintains the chair in a compact bundle as long as it remains in a carrying position as shown in FIG. 9. When the chair is in its collapsed or carrying position the front legs 16, 16, the bottom 14 and the back 18 which comprise the frame 12 are disposed generally adjacent each other and extend in the same general direction. In the collapsed condition the front legs and the back are generally disposed in parallel planes relative to each other.

The chair 10 can be rapidly deployed from its carrying position of FIG. 9 to its open or operative position of FIG. 2 by reversing the motions generally aforedescribed. Thus, when the chair is unslung from the shoulder and grounded it may be readily opened by releasing the carrying strap 22 and grasping the upper portion of the chair back and moving it to its preadjusted back supporting position relative to the bottom 14.

In its set-up position the chair is close to the ground, presents a low profile and may be used to view an event without obstructing the view of other spectators in the immediate area. The advantages of the chair derived from its lightweight, portability and manner in which it may be collapsed to a carrying position and rapidly deployed from the carrying position to an operative position will be most appreciated when the chair is used at a moving sporting event, such as a golf tournament, for example, where it may be necessary to collapse and deploy the chair, numerous times during the event to follow and observe the play of a favorite player or group of players proceeding around the course.

Figure 10:
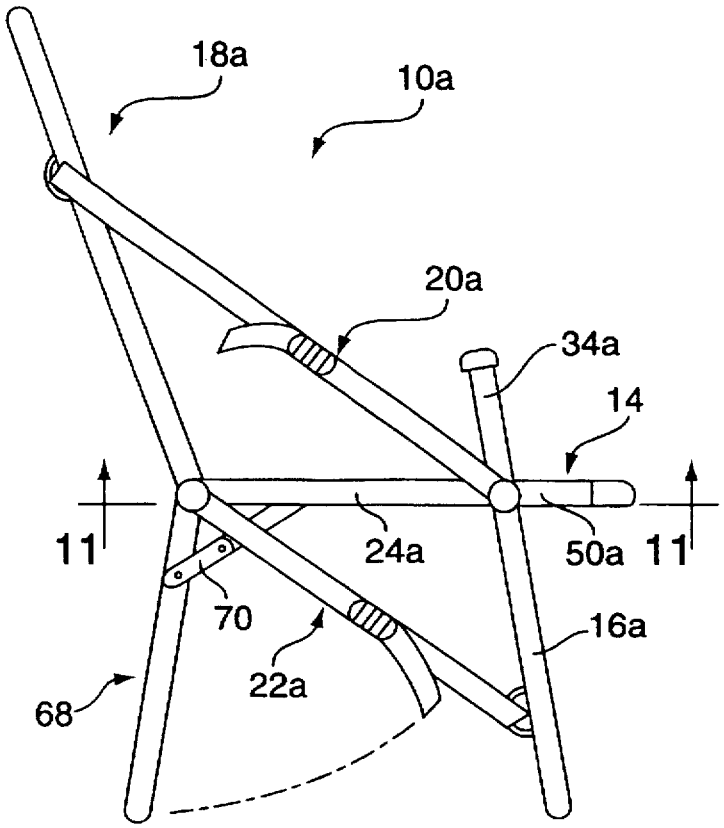
FIG. 10 is a side elevational view of another collapsible multi-purpose chair embodying the invention.
Figure 11:
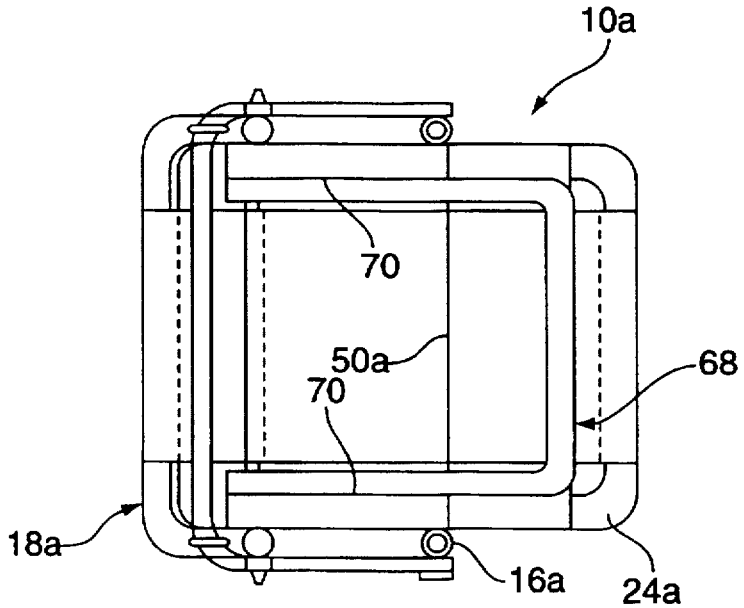
FIG. 11 is a sectional view taken along the line 11 of FIG. 10 and shown with the rear legs folded to collapsed condition.

The chair may be provided with a pair of rear legs having an operative length substantially equal to the operative length of the front legs for cooperating with the front legs to support the bottom or seat at a conventional chair seat height above the ground or supporting surface. Such a modified embodiment of the chair is shown in FIGS. 10 and 11 and indicated generally at 10*a*. Parts of the chair 10*a* identical to parts previously described bear the same reference numerals as the previously described parts and a latter "a" suffix. The rear legs preferably comprise part of a generally U-shaped rear member or rear leg assembly indicated at 68. The free end portions of the U-shaped rear member 68 are disposed inwardly of the rear end portions of the U-shaped bottom member 24*a* and are preferably connected to the rear end portion of the bottom member by the pivot rod 38*a*. A pair of foldable latching links 70, 70 disposed at opposite sides of the frame 12*a* and connected between the rear member 68 and the bottom member 24*a*, substantially as shown, maintain the rear member 68 in either an operative condition, as it appears in FIG. 10, or in a collapsed condition, shown in FIG. 11. In its collapsed condition the rear member 68 is disposed generally within the plane of the bottom 14*a* and within the confines of the tubular bottom member 24*a*, as shown in FIG. 11.

Figure 12:
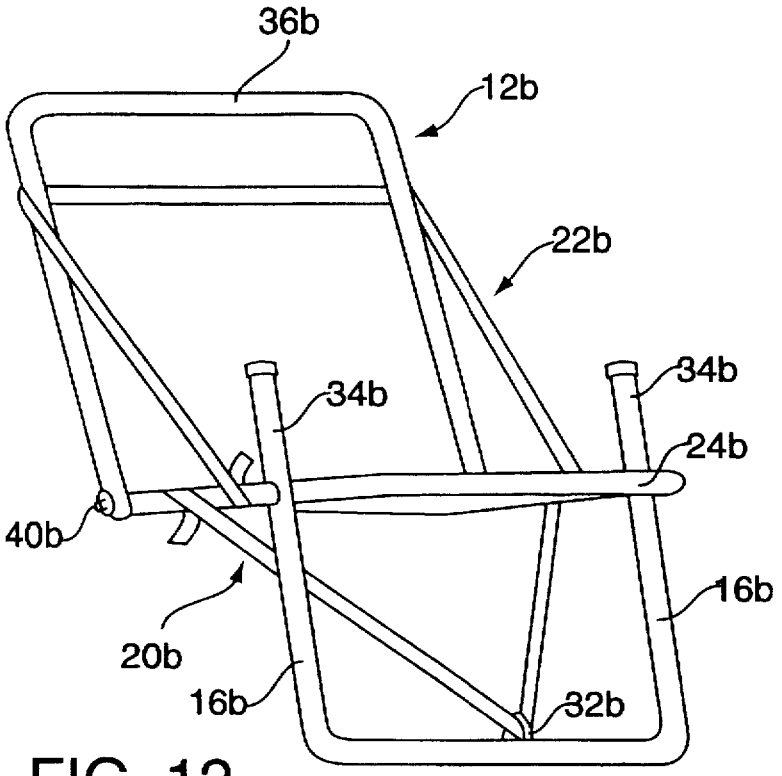
FIG. 12 is a perspective view showing the frame of another chair embodying the invention.

In FIG. 12 a further embodiment of the invention is illustrated with reference to a chair frame 12*b* wherein another arrangement is employed for connecting an adjustable retaining strap 20*b* and an adjustable carrying strap 22*b* to the frame. A single eye 32*b* is provided at the central portion of the tubular front member 26*b* for receiving the retaining strap 20*b*. The free ends of the retaining strap 20*b* are connected to opposite sides of the bottom member 24*b* rearwardly of the pivot pins 28*b*, 28*b*. The free ends of the carrying strap 22*b* are secured to the side portions of the bottom member 24*b*, substantially as shown. Any suitable means may be provided for adjusting the effective length of the flexible straps 20*b* and 22*b*. Such an arrangement may, for example, include adjustable strap fasteners secured directly to the frame 12*b*, but not shown.

Figure 13:
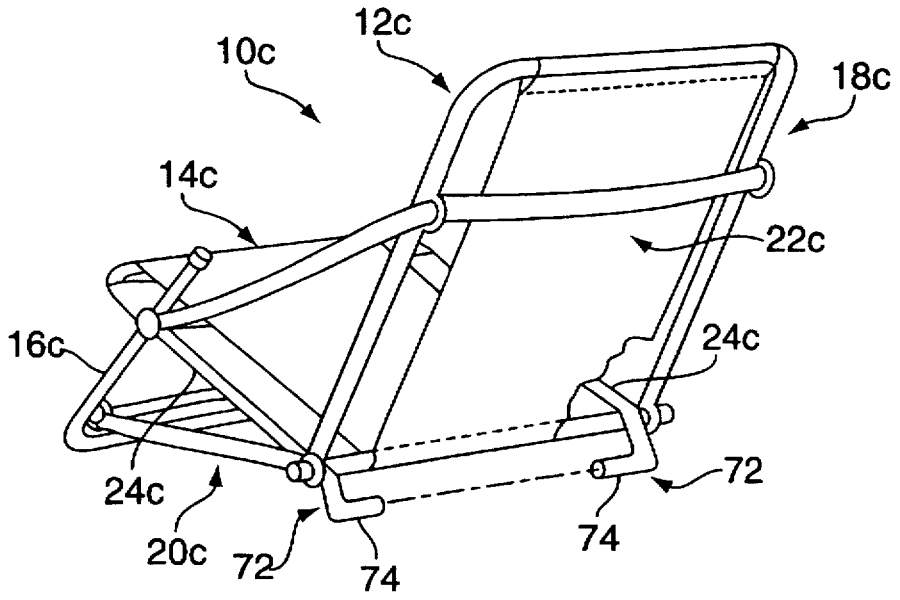
FIG. 13 is a perspective view of still another chair embodying the invention.

Referring now to FIG. 13, another collapsible chair embodying the invention is indicated generally by the reference numeral 10*c*. The illustrated chair 10*c* is substantially identical in most respects to the chair 10 illustrated in FIGS. 1–9 and previously described. Specifically, the chair 10*c* has a frame indicated generally at 12*c* which includes a pair of front legs 16*c*, 16*c* (one shown) pivotally connected to a bottom or seat indicated generally at 14*c*, for movement between operative and collapsed positions. A back 18*c* is also supported for pivotal movement relative to the bottom 14*c* between operative and collapsed positions, substantially as aforedescribed with reference to the chair 10. The front legs are maintained in operative position relative to the bottom by a flexible retaining strap indicated generally at 20*c* whereas the back 18*c* is retained in a selected position of angular adjustment relative to the seat by another strap 22*c* which also serves as a carrying strap for collapsing the chair and carrying it in its collapsed position, as hereinbefore more fully discussed.

The chair 10*c* differs from the previously described chair 10 in that it has a pair of back legs designated generally by the numerals 72, 72. The back legs 72, 72 have a substantially shorter operative length than the front legs 16*c*, 16*c* and are connected in fixed position to the bottom 14*c*. Specifically, the bottom member 24*c* includes a pair of laterally spaced apart side members and each back leg 72 comprises an extension of an associated one of the side members. Each back leg 72 is rearwardly and downwardly inclined from its associated side member, substantially as shown. The tubular back legs 72, 72 have free end portions indicated at 74, 74 which extend coaxially toward each other as shown in FIG. 13. The extending free end portions 74, 74 increase the bearing surface of the back legs 72, 72 for improved support when the chair is used on soft ground.

Figure 14:
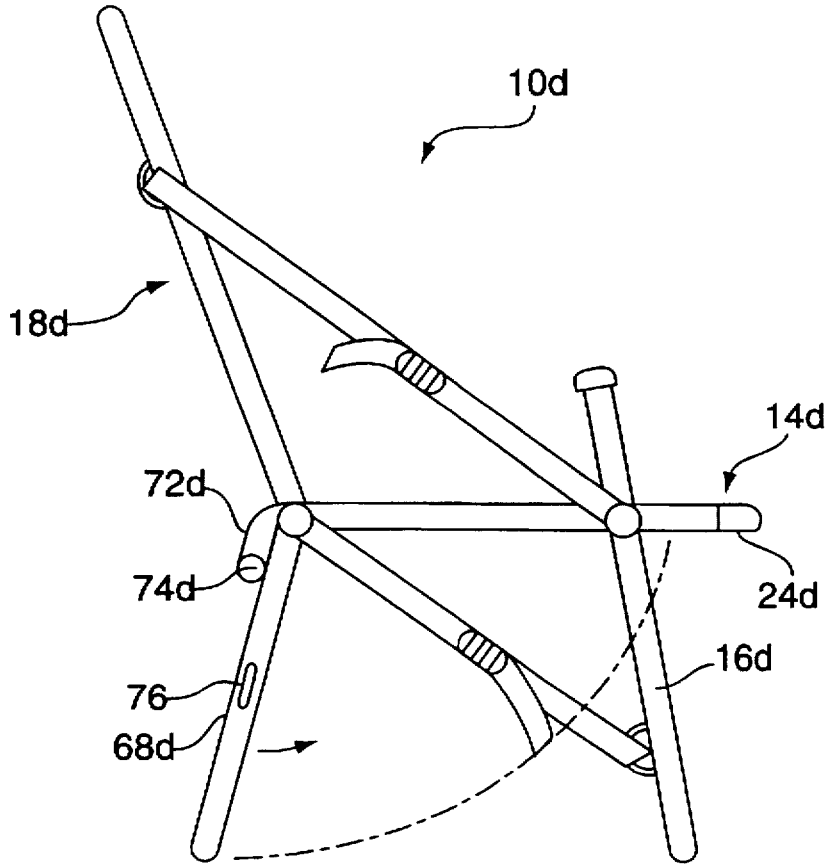
FIG. 14 is a side elevational view of yet another chair embodying the invention.

In FIG. 14 there is shown still another chair embodying the invention and indicated generally by the reference numeral 10*d*. The illustrated chair 10*d* is substantially identical to the chair 10*c* shown in FIG. 13 and like the latter chair 10*c* includes back legs 72*d*, 72*d* (one shown). However, the chair 10*d* differs from the previously described chair 10*c* in that it also includes collapsible rear legs defined by a generally U-shaped rear member 68*d* identical to the rear member 68 illustrated in FIGS. 10 and 11. The collapsible rear member 68 defines rear legs which have an effective operative length substantially equal to the operative length of the front leg assembly which includes the legs 16*d*, 16*d*. Accordingly, when the chair 10*d* is in its set-up or operative position the front and rear legs support the chair bottom or seat 14*d* at a conventional chair seat height, that is about 18 inches above the chair supporting surface. In its operative position the collapsible rear leg assembly 68*d* is inclined downwardly and rearwardly from its pivotal connection to the back 18*d* and seat 14*d*. In the latter position each of the rear legs which comprise the collapsible rear leg assembly 68*d* engages the free end 74*d* of an associated back leg 72*d*, substantially as shown in FIG. 14. When the chair 10*d* is in its collapsed position the rear leg assembly 68*d* is folded to its collapsed position shown in FIG. 11 wherein it is disposed within the confines of the U-shaped bottom frame member 24*d*. An appropriate means is provided for maintaining the rear leg assembly 68*d* in its collapsed position and may, for example, include a detent projection or rib 76 on at least one of the rear legs which comprise the rear leg assembly 68*d* for engagement within an associated complementary detent recess (not shown) formed in the inner side of an associated one of the side members which comprise the bottom frame member 24*d*.

I claim:

1. A portable collapsible chair having operative and collapsed positions and comprising a back, a bottom connected to said back for pivotal movement relative to said back, said bottom in said operative position being generally horizontally disposed, said back in said operative position extending generally upwardly from a rear portion of said bottom, said bottom in said collapsed position extending generally upwardly adjacent said back, and carrying means including an elongated flexible carrying strap having opposite ends connected to said bottom forward of said back and connected to said back at spaced apart points of operable connection, said carrying strap defining a carrying portion exposed between said points of operable connection, said carrying strap being freely movable relative to said back at said points of operable connection between back retaining and carrying positions for supporting said back in said operative position relative to said bottom when said carrying strap is in its back retaining position relative to said chair and for moving said chair from its operative position to its collapsed position in response to lifting force applied to said carrying portion to move said carrying strap from said back retaining position to said carrying position, said carrying strap further comprising means for maintaining said chair in said collapsed position while said carrying strap is in said carrying position, whereby said carrying strap may be employed as a shoulder strap for carrying said portable chair in its collapsed condition.

2. A portable collapsible chair as set forth in claim 1 including a front leg assembly supported on said chair bottom and wherein said front leg assembly and said back are movable independently of each other and relative to said chair bottom.

3. A portable collapsible chair as set forth in claim 2 wherein said front leg assembly, said bottom and said back extend in a single general direction in said collapsed position.

4. A portable collapsible chair as set forth in claim 2 wherein said front leg assembly and said back are disposed in generally parallel planes in said collapsed position.

5. A portable collapsible chair as set forth in claim 2 wherein said front leg assembly is supported for pivotal movement between said collapsed and said operative position relative to said bottom.

6. A portable collapsible chair as set forth in claim 2 wherein said chair includes a front leg assembly retaining means comprising a flexible member.

7. A portable collapsible chair as set forth in claim 6 wherein said flexible member comprises another strap.

8. A portable collapsible chair as set forth in claim 6 wherein said front leg assembly retaining means is if further characterized as means for maintaining said front leg assembly in a selected one of a plurality of operative positions and said chair includes adjusting means for varying the effective operative length of said flexible member to alter the operative position of said front leg assembly.

9. A portable collapsible chair as set forth in claim 8 wherein said flexible member comprises another strap.

10. A portable collapsible chair as set forth in claim 2 wherein said front leg assembly, said bottom, and said back each comprise generally U-shaped tubular members.

11. A portable collapsible chair as set forth in claim 10 wherein said front leg assembly and said back are supported for independent forward and rearward pivotal movement relative to said bottom between said operative and collapsed positions.

12. A portable collapsible chair as set forth in claim 2 wherein said front leg assembly includes a pair of front legs and said chair includes a pair of back legs having a substantially shorter operative length than said front legs.

13. A collapsible chair as set forth in claim 12 wherein said chair includes a pair of collapsible rear legs having an operative length substantially equal to the operative length of said front legs and supported for movement between operative and collapsed positions relative to said bottom and said chair further includes means for maintaining said collapsible rear legs in said operative position.

14. A collapsible chair as set forth in claim 13 wherein said back legs comprise said means for maintaining said collapsible rear legs in said operative position.

15. A portable collapsible chair as set forth in claim 12 wherein said back legs are connected in fixed position to said bottom.

16. A collapsible chair as set forth in claim 15 wherein said bottom includes a pair of laterally space apart bottom side portions and each of said back legs comprise an extension of one of said bottom side portions.

17. A portable collapsible chair as set forth in claim 16 wherein each of said back legs in said operative position is rearwardly and downwardly inclined from an associated one of said bottom portions side.

18. A portable collapsible chair as set forth in claim 17 wherein said back legs have free end portions coaxially extending toward each other.

19. A portable collapsible chair as set forth in claim 1 wherein said carrying means is further characterized as means for retaining said back in a multiplicity of operative positions relative to said bottom and said chair includes adjusting means for varying the effective operative length of said carrying strap to retain said back in a selected one of said operative positions.

20. A portable collapsible chair as set forth in claim 1 wherein said chair includes a sheet of flexible material partially defining said back and said bottom.

21. A collapsible chair as set forth in claim 1 wherein each of said front legs has a free upper end portion extending upwardly beyond said bottom in said operative position.

22. A collapsible chair as set forth in claim 1 wherein said chair includes an elongated rod having opposite end portions and supporting said back on said bottom for pivotal movement between said operative and said collapsed positions and said front leg retaining means comprises a flexible strap connected to said front legs and having end portions connected to said opposite end portions of said rod.

23. A collapsible chair as set forth in claim 1 wherein said chair has a front leg assembly supported on said chair bottom for pivotal movement relative to said chair bottom between operative and collapsed positions independently of the movement of said chair bottom relative to said chair back, said leg assembly defining a pair of legs extending generally downwardly from said chair bottom in said operative position and being disposed in adjacent parallel relation to said chair back in said collapsed position, and flexible means for maintaining said leg assembly in said operative position, said leg assembly being moveable from said operative position to said collapsed position in response to movement of said carrying strap from said back retaining position to said carrying position.

24. A collapsible chair as set forth in claim 23 wherein said chair includes legs positioning means for positively positioning said leg assembly in its collapsed position in response to movement of said carrying strap from its back retaining position to its carrying position.

25. A collapsible chair as set forth in claim 23 wherein said flexible means comprises a flexible strap connecting said leg assembly to another part of said chair.

26. A collapsible chair as set forth in claim 24 wherein said leg positioning means comprises upper end portions of said legs projecting above and terminating in upwardly spaced relation to said chair bottom when said legs are in said operative position.

27. A collapsible chair as set forth in claim 1 wherein said chair has a rear leg assembly including a pair of rear legs movable between collapsed and operative positions relative to said bottom member and means for releasably retaining said rear leg assembly in operative position and in collapsed position relative to said bottom member.

28. A collapsible chair as set forth in claim 27 wherein said front leg assembly, said back, said bottom member and said rear leg assembly all extend in a single direction in said collapsed position.

29. A foldable chair comprising a frame foldable between operative and collapsed position and having a generally U-shaped rearwardly open bottom member including a pair of parallel bottom side portions and a front portion integrally connected to forward ends of said bottom side portions and extending laterally therebetween, a generally U-shaped upwardly open front member including a pair of front legs and a leg connecting portion integrally connected to lower ends of said front legs and extending laterally therebetween, said front member straddling an associated portion of said bottom member, each of said legs being connected to an associated one of said bottom side portions for pivotal movement relative to said bottom member about a common pivotal axis extending laterally of said bottom member, each of said front legs having a free upper end part extending above said bottom member when said chair is in its operative position, and a generally U-shaped downwardly open back member including a pair of back side portions and an upper connecting member integrally connected to and extending laterally between upper ends of said back side portions when said chair is in its operative position, a lower end portion of each of said back side portions being pivotally connected to a rear end portion of an associated bottom side portion by an elongated rod extending laterally of and through the rear end portions of said bottom side portions and the bottom end portions of said back side portions members, said rod supporting said back member for pivotal movement relative to said bottom member between operative and collapsed positions, front leg retaining means for maintaining said front legs in selected operative position relative to said bottom member and including a first flexible strap connected to said front member and means for varying the effective operative length of said first flexible strap, and carrying means moveable between a back member retaining position and a carrying position for maintaining said back member in operative position relative to said bottom member when said carrying means is in its back member retaining position, moving said front member and said back member to collapsed position relative to said bottom member when said carrying means is manually brought to carrying position, and maintaining said front member and said back member in collapsed position when said chair is carried by said carrying means in said carrying position and including a second flexible strap connected to said back member for movement relative to said back member and means for adjusting the effective operative length of said second flexible strap.

30. A foldable chair as set forth in claim 29 wherein said chair in collapsed position comprises a compact bundle having said front leg assembly, said bottom and said back all extending in a single direction.

31. A foldable chair as set forth in claim 29 wherein said chair has a pair of back legs having a substantially shorter operative extent than said front legs and comprising rearward extensions of said bottom side portions.

32. A foldable chair as set forth in claim 31 wherein said back legs having free end portions coaxially extending toward each other.

33. A collapsible chair comprising a bottom, a pair of front legs supported by said bottom for movement between operative and collapsed positions, front leg retaining means for maintaining said front legs in operative position relative to said bottom, a back, an elongated rod pivotally connecting said back to said bottom for pivotal movement between operative and collapsed positions, a sheet of flexible material partially defining said bottom and said back and connected to said rod, and carrying means moveable between a back retaining position and a carrying position for maintaining said back in operative position relative to said bottom when said carrying means is in said back retaining position, moving said front legs and said back to collapsed position relative to said bottom when said carrying means is moved from said back retaining position to said carrying position, and maintaining said front legs and said back in collapsed position when said carrying means is in said carrying position and while said chair is carried by said carrying means in said carrying position.

34. A portable collapsible chair as set forth in claim 33 wherein said front legs comprise a front leg assembly and said front leg retaining means comprises an elongated flexible member connected to said front leg assembly and to another part of said chair.

35. A portable collapsible chair comprising a chair back, a chair bottom connected to said chair back for movement relative to said chair back between an operative position wherein said chair bottom is disposed in a generally horizontal seating position and said chair back extends generally upwardly from said chair bottom and a collapsed position wherein said chair bottom extends upwardly in generally adjacent relation to said chair back, a pair of spaced apart eyes mounted on said chair back and exposed at the rear of said chair back, an elongated flexible carrying strap threaded through and freely movable relative to said eyes, said carrying strap having opposite end portions connected to said chair bottom forward of said chair back, said carrying strap assuming a back retaining position when said chair is in its operative position, said carrying strap in said back retaining position extending across said chair back at the rear of said chair back and defining an exposed portion located at the rear of said chair back and between said eyes, said carrying strap in said back retaining position supporting said chair back in its upwardly extending position relative to said chair bottom, said carrying strap having a carrying position wherein said chair bottom and said chair back are suspended from portions of said carrying strap depending from said carrying portion, said chair being moveable from said operative position to said collapsed position in response to lifting force applied to said carrying portion to move said carrying strap from said back retaining position to said carrying position when said chair is in its operative position, said carrying strap in said carrying position maintaining said chair in said collapsed position, whereby the carrying strap may be employed as a shoulder strap for carrying said chair in said collapsed position.

36. A portable collapsible chair comprising a chair back, a chair bottom connected to said chair back for movement relative to said chair back between an operative position of said chair wherein said chair bottom is disposed in a generally horizontal seating position and said chair back extends generally upwardly from said chair bottom and a collapsed position of said chair wherein said chair bottom extends upwardly in generally adjacent relation to said chair back, means for defining a pair of spaced apart eyes on said chair back, an elongated flexible carrying strap threaded through and freely movable relative to said eyes, said carrying strap having opposite end portions connected to said chair bottom forward of said chair back, said carrying strap assuming a back retaining position when said chair is in its operative position, said carrying strap in said back retaining position extending across said chair back and defining an exposed carrying portion between said eyes, said carrying strap in said back retaining position supporting said chair back in its upwardly extending position relative to said chair bottom, said carrying strap having carrying position wherein said chair bottom and said chair back are suspended from portions of said carrying strap depending from said carrying portion, said chair being movable from said operative position to said collapsed position in response to lifting force applied to said carrying portion to-move said carrying strap from said back retaining position to said carrying position when said chair is in its operative positions said carrying strap in said carrying position maintaining said chair in said collapsed position, whereby the carrying strap may be employed as a shoulder strap for carrying said chair in said collapsed position when said carrying strap is in said carrying position.

37. A portable collapsible chair as set forth in claim 36 wherein said chair back is pivotally moveable between its collapsed and its operative positions relative to said bottom.

38. A portable collapsible chair as set forth in claim 36 wherein said chair has a leg assembly including a pair of legs connected to said bottom for pivotal movement in unison relative to said bottom, said legs in said operative position extending generally downwardly from said bottom, said legs in said collapsed position being disposed generally adjacent said back, said legs being moveable from said operative position to said collapsed position in response to movement of said carrying means from said back retaining position to said carrying position.

39. A portable collapsible chair as set forth in claim 35 wherein said chair includes leg deploying means for positively urging said legs to said collapsed position during movement of said carrying means from said back retaining position to said carrying position and for retaining said legs in said collapsed position while said carrying means is in said carrying position.

40. A portable collapsible chair as set forth in claim 35 wherein said deploying means comprises upward extensions of said legs terminating above said bottom in said operative position.

41. A portable collapsible chair comprising a chair frame foldable between operative and collapsed positions and including a back member, a bottom member connected to said back member for pivotal movement relative to said back member, said bottom member in said operative position being generally horizontally disposed, said back member in said operative position extending generally upwardly from a rear portion of said bottom member, said bottom member in said collapsed position extending generally upwardly adjacent said back member, front leg assembly supported on said chair bottom for pivotal movement relative to said chair bottom between operative and collapsed positions independently of the movement of said chair bottom relative to said chair back, said leg assembly defining a pair of legs extending generally downwardly from said chair bottom in said operative position and being disposed in adjacent parallel relation to said chair back in said collapsed position, flexible means for maintaining said leg assembly in said operative position and including a flexible strap connecting said leg assembly to another part of said chair, and carrying means connected to said bottom member and to said back member and movable relative to said chair frame between back retaining and carrying positions for supporting said back member in its operative position relative to said bottom member when said carrying means is in its back retaining position relative to said chair frame from its operative position to its collapsed position in response to lifting force applied to said carrying means to move said carrying means from said back retaining position to said carrying position, said leg assembly being moveable from said operative position to said collapsed position in response to movement of said carrying strap from said back retaining position to said carrying position, said carrying means further comprising means for maintaining said chair frame in said collapsed position while said carrying means is in said carrying position.

* * * * *